US005522784A

United States Patent [19]

Grant

[11] Patent Number: 5,522,784

[45] **Date of Patent: * Jun. 4, 1996**

[54] EXERCISE APPARATUS

[76] Inventor: Eugene J. P. Grant, 35 Harborview Dr., Racine, Wis. 53403

[ * ] Notice: The term of this patent shall not extend beyond the expiration date of Pat. No. 5,348,524.

[21] Appl. No.: 304,089

[22] Filed: Sep. 9, 1994

Related U.S. Application Data

[63] Continuation of Ser. No. 169,071, Dec. 20, 1993, Pat. No. 5,348,524.

[51] Int. Cl.[6] ..... A63B 21/04

[52] U.S. Cl. ..... 482/130; 482/138

[58] Field of Search ..... 482/99–103, 121–130, 482/133–138, 908, 92, 93, 98; 73/379.08

[56] References Cited

U.S. PATENT DOCUMENTS 4,564,191 1/1986 Atkin .
4,600,196 7/1986 Jones .
4,666,149 5/1987 Olschansky et al. .
4,733,860 3/1988 Steffe .
4,811,946 3/1989 Pelczar .
5,039,092 8/1991 Olschansky et al. .
5,110,121 5/1992 Foster .
5,348,524 9/1994 Grant ..... 482/130

*Primary Examiner*—Richard J. Apley
*Assistant Examiner*—Victor K. Hwang
*Attorney, Agent, or Firm*—J. E. Brunton

[57] ABSTRACT

A non-gravity type resistance exercise apparatus which is small, light weight, highly versatile, safe and easy to use. The apparatus includes a compact, self-contained selectorized resistance module that embodies a plurality of discrete elastomeric cords that can be quickly and easily selectively coupled with a gripping member to provide precise resistance to movement of the gripping member during the performance of a large number of different kinds of exercises by the trainee. The apparatus also uniquely includes a supporting frame of limited height to which a pulley carrying exercise arm is pivotally connected for movement between a lowered, compact storage position to an intermediate position to a raised latissimus exercise position.

9 Claims, 8 Drawing Sheets

84
84
20
20
20
80
12
102
16r
18
16
23
58
82
116
90
95
94-96
14
54
100
20
102
23
44
16s
16t
21
21
24
24
21
21
20
80
14
113
22
37
37
40a
40
44
40
16
40
26
36a
40
36
68
26
36b
36
74
50
70
68
84
36c
50b
68
62
62
60
64
92
50a
50
60
99
98
56

7
100
102
16i
16g
16e
16c
16a
16b
16d
16f
16h
16j
18
23
14
16
16s
44
21
21a
26a
26
40
68b
68
58
30
32c
32a
37a
37b
32b
37c
37d
37e
37f
37g
37h
37i
37j
74
70
78
36a
36b
36
36c
84
75
70b
50b
76
80
74a
64
68a
50a
50

18
16r
23
16
16t
21a
21
16s
24
22
22a
22b
44
100
102
14
16s
23
44
16t
21
21a
40
30p
40a
32a
24
52
50c
37a
26c
26
22
36
36b
36a
68
27
74
36c
75
70
84
70b
50b
68a
62
64
50a
50
58
60

20
100
102
16g
16i
23
23
16f
16h
16j
18
18
14
16
16
12
11
23
23
16s
16s
44
44
21
21
21a
21a
24
24
22
22
16e
16c
16a
16d
16b
21
21
21
21
37a
37e
37d
30
30
26a
26
40
40
68b
68b
37c
37b
32d
26c
32e
32c
32a
32b
68
68
12
11
74
74
84
84
-36a-
36b
36b
70
70
75
75
36c
36
70b
70b
50b
50b
74e
74e
76
76
78
78
80
80
50
50a
68a
68a
58
58
64
64
-62-
60

52
40a
38
32i
32g
32e
32c
32a
32b
32d
32f
32h
32j
50c
26
27
30i
30g
30e
30c
30a
30b
30d
30f
30h
30j
40
42
26b
26c
26a
68b
68
74
68a
70
68
80
74
78
76
37c
37e
37g
37i
37a
37b
36
37d
37f
37h
37j
70
84
36a
70b
36
72
36c
50b
70
78
62
50
50a
50b

EXERCISE APPARATUS

BACKGROUND OF THE INVENTION

This is a Continuation Application of application, Ser. No. 08/169,071 filed Dec. 20, 1993 now U.S. Pat. No. 5,348,524.

FIELD OF THE INVENTION

The present invention relates generally to a body exercising apparatus and more particularly to a compact, multipurpose exercise machine for accomplishing a number of progressive resistance type exercises using a novel elastomeric band resistance unit which provides a variable resistance to the performance of the exercises.

DISCUSSION OF THE PRIOR ART

The therapeutic value of progressive resistance exercises has long been recognized. Exercising muscles against progressively increasing resistance not only results in added strength and endurance in the muscles, but also in the improvement of neuromuscular coordination and in a more efficient functioning of the cardiovascular and respiratory systems.

In the past, various types of progressive weight training machines have been suggested. Among these prior art devices are those described in U.S. Pat. No. 4,339,125 issued to Uyeda, et al., U.S. Pat. No. Re. 28,066 issued to Marcy, and in U.S. Pat. No. 3,912,263 issued to Yatso.

Typically the prior art exercise apparatus uses one or more weights selected from a stack of weights to provide gravity resistance to the movement of a carriage or other body engaging means. Such apparatus is inherently very heavy and not well suited for use in certain facilities. Additionally, the prior art apparatus is typically quite bulky and difficult to use in confined areas having limited ceiling heights. Further, the weight and bulk of the prior art devices makes their storage and transport quite difficult.

In an attempt to make exercise apparatus lighter and less bulky, several exercise devices have been suggested which use elastomeric members rather than weights to provide non-gravity resistance to the performance of the exercises. One of the earliest of such devices is described in U.S. Pat. No. 4,072,309 issued to Wilson. This latter device uses circular spring cords, such as aircraft shock cords, to resist movement of a lever arm which is pivotally connected to an upright structural member. Following commercialization of the Wilson device, several other types of exercise devices have been suggested which use elastomeric members in the form of relatively heavy, solid rubber resistance-imparting elements.

The prior art elastomeric cord or solid rubber resistance type units are, of course, much lighter than the solid weight type units, but are still quite bulky and difficult to use and store in areas having limited ceiling height. Another drawback of many of the elastomeric resistance type exercise apparatus is that, in most cases, the resistance elements must be placed on each side of the lifting mechanism to maintain a balanced resistance. Further the prior art resistance elements tend to crack and fatigue making them susceptible to catastrophic failure. Additionally, varying the resistance in many of the prior art elastomeric resistance type units involves adding or subtracting individual elastomeric elements to the apparatus. This can be both cumbersome and time consuming. Further, since the elastomeric resistance elements are typically separate units, they can be lost or misplaced and frequently are strewn about the apparatus in a manner to create substantial tripping hazards.

The apparatus of the present invention overcomes many of the drawbacks of the prior art exercise devices by providing an apparatus that is compact, lightweight, and readily usable in confined areas. The apparatus includes a highly novel, non-gravity, self-contained selectorized resistance module that is made up of a number of elastomeric cords which are assembled together into a compact resistance module which offers variable resistance from a single connection point on the module thereby always providing balanced resistance. A unique selector means permits a selected number of the elastomeric cords of the resistance module to be quickly and easily interconnected with the body engaging means of the apparatus to provide precisely variable resistance to the performance of the given exercise. The selector module can be vertically, horizontally or angularly inclined relative to the floor so that a large number of different exercises can be performed in confined areas. Each elastomeric cord is contained within the resistance module and separate resistance elements need not be connected to or removed from the apparatus in order to vary the effective resistance.

Another novel feature of the apparatus of the invention, which is not found in the prior art, is the provision of a compact basic supporting frame of limited height to which an elongated, pulley-carrying exercise arm is pivotally connected. The exercise arm conveniently rotates between a low, pulley exercise position and a high latissimus exercise position. This unique feature allows the overall height of the apparatus to be reduced to approximately half that of prior art devices without in any way forfeiting the range of motion required for the proper performance of exercises such as latissimus, pull-down exercises. When the device is in the low pully exercise position, it is quite compact and easily storable.

SUMMARY OF THE INVENTION

It is an object of the present invention to provide an improved, non-gravity type resistance exercise apparatus which is small, light weight, highly versatile and easy to use. More particularly, it is an object of the invention to provide an exercising machine that includes a compact, self-contained, selectorized resistance module that embodies a plurality of discrete elastomeric cords which can be quickly and easily selectively coupled with the body engaging means to provide precise resistance to the performance of several different kinds of exercises.

Another object of the invention is to provide an apparatus of the aforementioned character which includes a supporting frame of limited height to which a pulley carrying exercise arm is pivotally connected. The pulley arm is conveniently movable from a lowered storage position to an intermediate position to a raised latissimus exercise position. A body engaging means, such as a handlebar, is connected to one end of a cable that is entrained about the pulley of the pulley arm. The opposite end of the cable is interconnected with the resistance module to provide precisely variable resistance to movement of the body engaging means during the performance of a particular exercise.

Another object of the invention is to provide an apparatus of the type described in the preceding paragraphs which includes a unique mechanism for selectively interconnecting the body engaging means with the selected resistance imparting cords of the resistance module. The elastomeric cords can be of the same or different elasticity so that a wide range of effective resistance can readily be achieved.

Another object of the invention is to provide an apparatus which provides readily variable resistance levels, similar or equal to those found on home and commercial exercise devices.

Another object of the invention is to provide a machine of the class described in which, during the performance of exercises, the resistance module can be vertically, horizontally or angularly inclined relative to the support frame supporting surface thereby substantially adding to the versatility of the apparatus.

Still another object of the invention is to provide a compact, light weight exercise machine that is both safe and reliable, while at the same time providing a full range of movement when performing exercixes.

Another object of the invention is to provide a device as described in the preceding paragraphs that embodies a minimum number of component parts and one which is easily operable without the use of selector pins or the like to vary resistance.

The superior engineering design of the apparatus of the present invention permits it to be inexpensively manufactured, easily set up and operated and conveniently stored in confined areas having limited ceiling height. Further, the unique design of the device permits it to be expanded or contracted to add or reduce the number of resistance cords provided in the resistance module.

DESCRIPTION OF THE INVENTION

Figure 1:
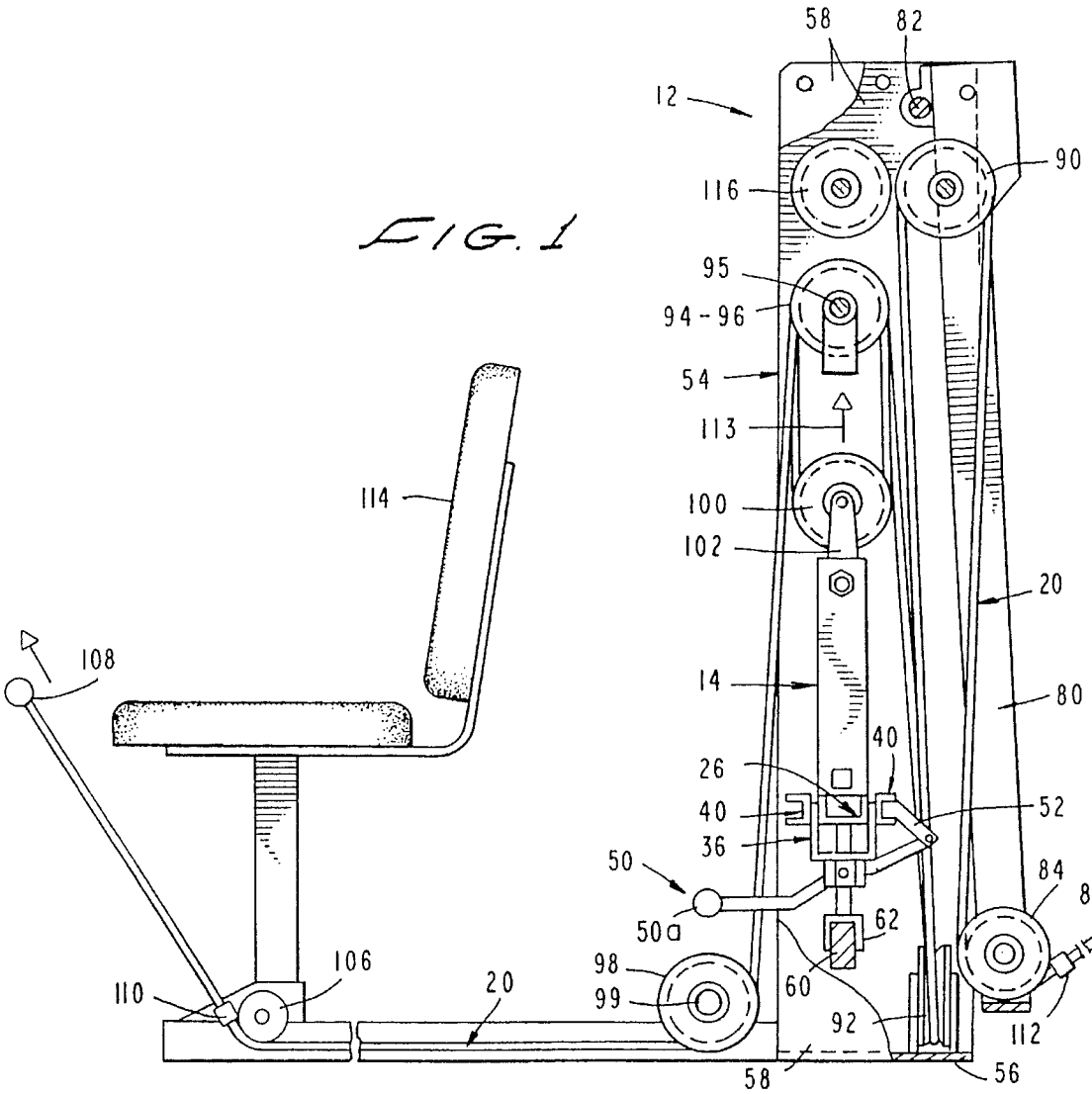
FIG. 1 is a side-elevational view of one form of the exercise apparatus of the invention.
Figures 2, 15:
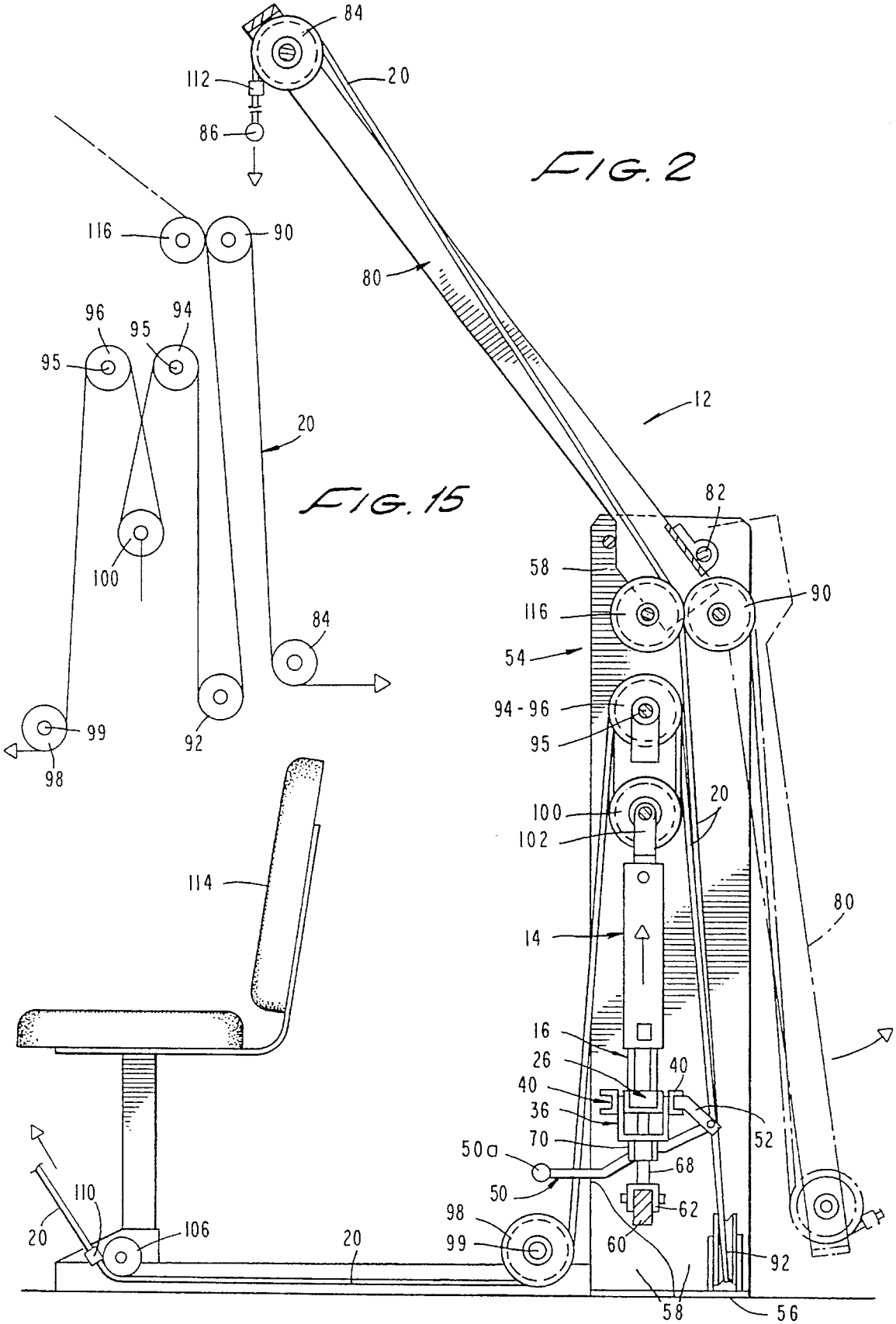
FIG. 2 is an enlarged, side-elevational view similar to FIG. 1, but illustrating the pulley arm of the apparatus having been moved from the low storage position to an upper, forward position.
FIG. 15 is a generally schematic view showing the cable routing of one form of the apparatus of the invention.
Figures 3, 5:
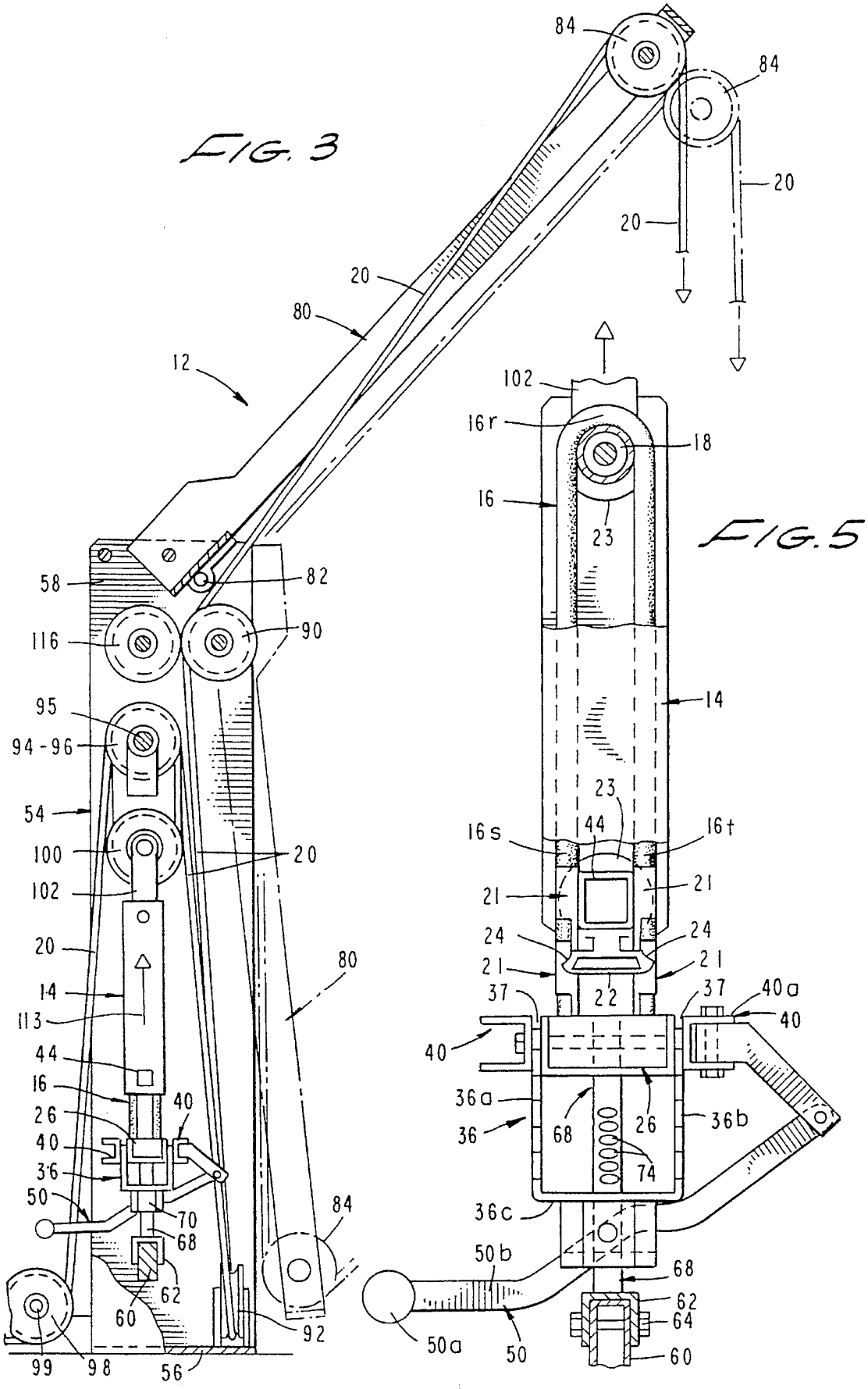
FIG. 3 is a fragmentary, side-elevational view similar to FIGS. 1 and 2 but showing the pulley arm of the apparatus in an intermediate position.
FIG. 5 is an enlarged, fragmentary view similar to FIG. 4 but showing the resistance means of the apparatus moved from a first position shown in FIG. 4 to a second elevated position shown in FIG. 5.

Referring to the drawings and particularly to FIGS. 1, 2, and 3, one form of the exercise apparatus of the present invention is there illustrated and generally designated by the numeral 12. The basic components of the apparatus include a body engaging means for engagement by the trainee in the performance of various types of exercises and a highly novel resistance means associated with the body engaging means for yieldably resisting movement of the body engaging means from a first to a second position. Also comprising a part of the apparatus of the invention is connector means of novel design for selectively interconnecting the resistance means with the body engaging means.

Figure 6:
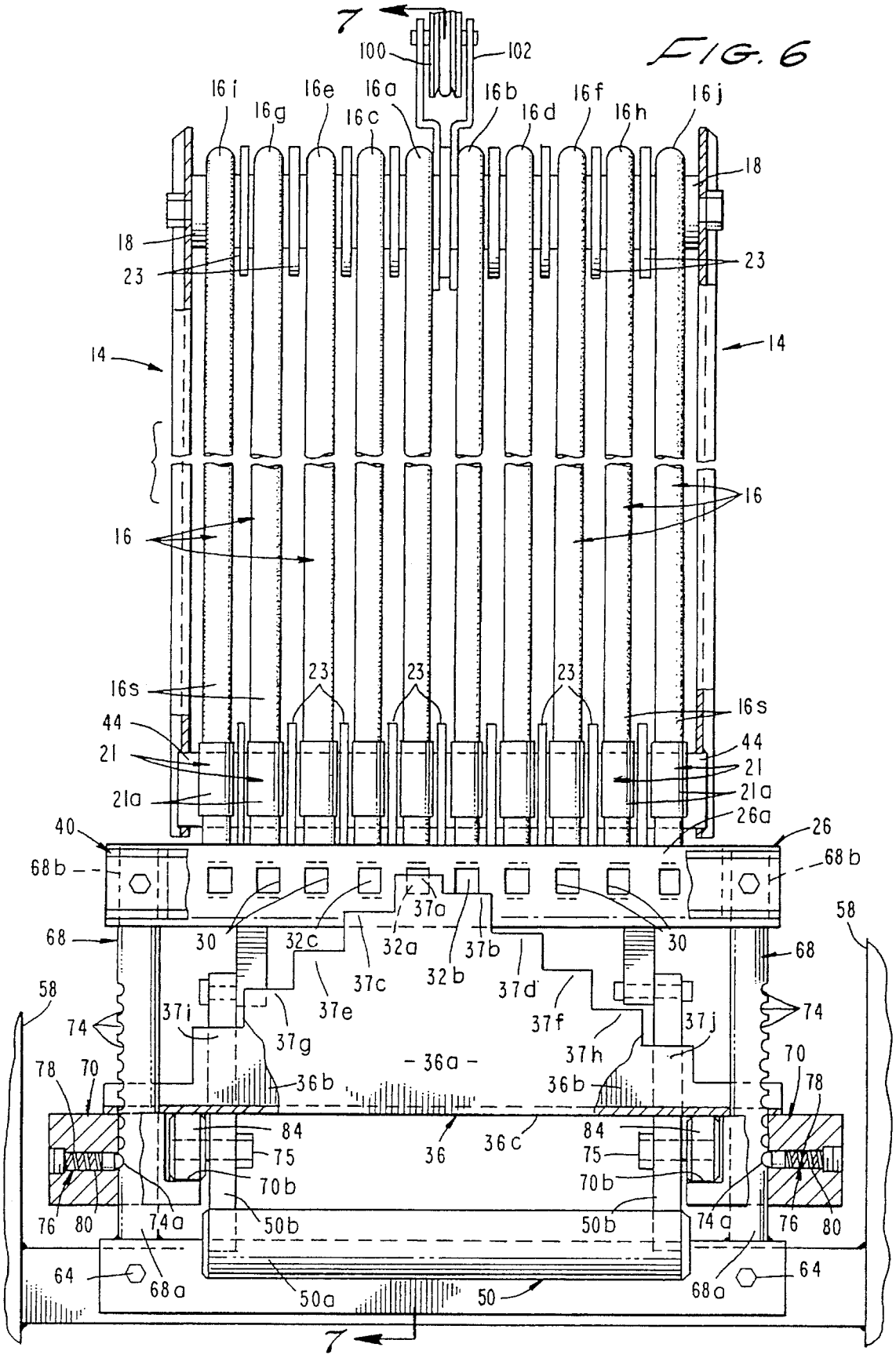
FIG. 6 is a greatly enlarged view taken along lines 6—6 of FIG. 4 illustrating the construction of the resistance means portion of the apparatus of the invention.
Figures 7, 8:
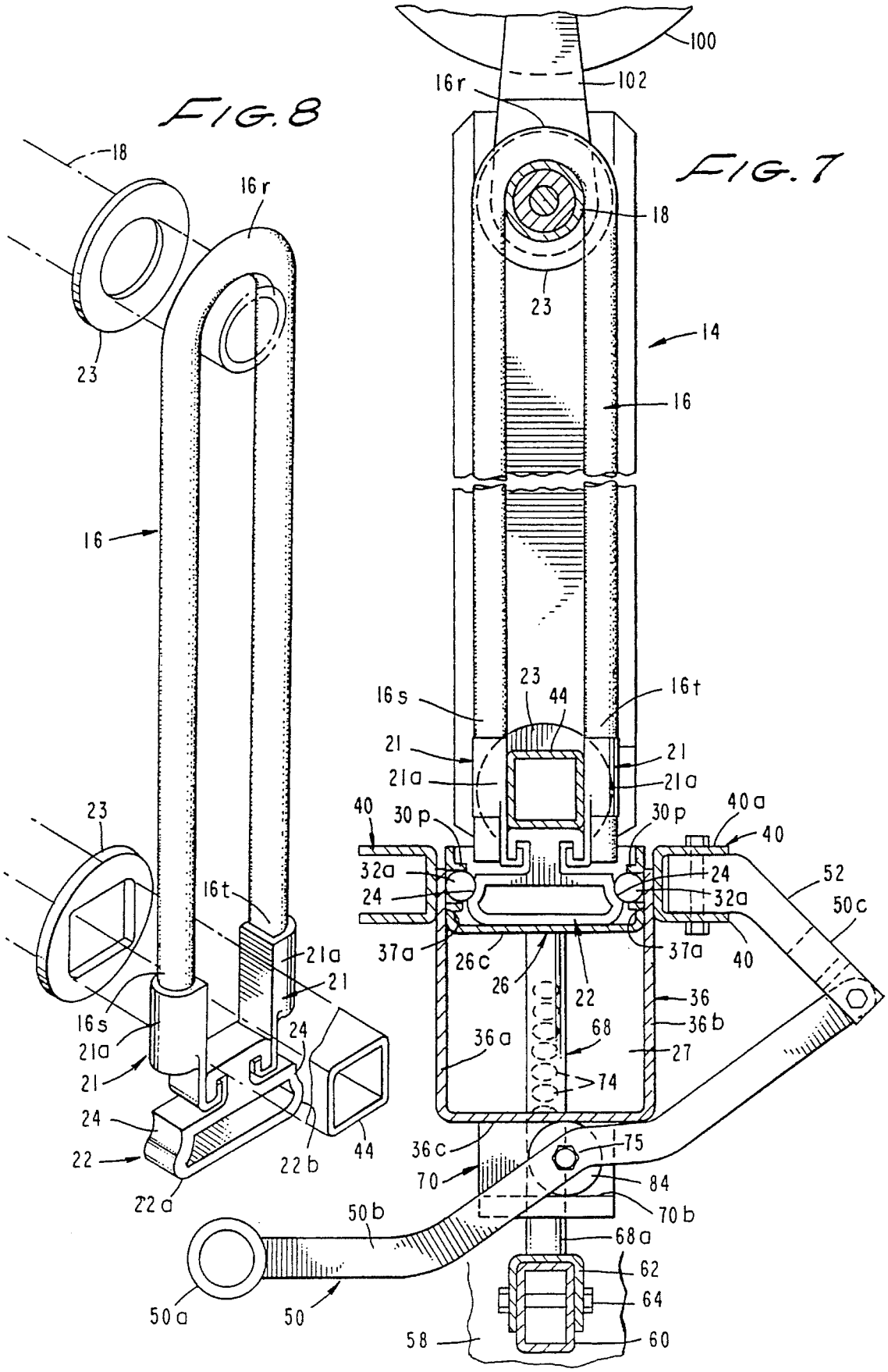
FIG. 7 is a cross-sectional view taken along lines 7—7 of FIG. 6.
FIG. 8 is a fragmentary, perspective view illustrating the configuration of one of the resistance cord assemblies of the apparatus.

At the heart of the present invention is the unique, non-gravity resistance means which, as best seen in FIGS. 6, 7, and 8 here comprises a novel selectorized resistance module 14 which comprises a plurality of stretchable elastomeric members or cords 16 which are entrained about an elongated cord supporting member or bar 18. In a manner presently to be described, bar 18 is interconnected with an elongated cable 20 to which the body engaging means of the apparatus is connected.

As best seen in FIG. 8, in the present form of the invention, each elastomeric cord 16 includes a bight portion **16*r* which passes around bar 18 and first and second ends 16*s* and 16*t* which are received within the leg portions of a generally U-shaped member 21. Connected to each member 21 is a connector element 22 which includes first and second curved edge portions 22*a* and 22*b*. Each edge portion is provided with a roller receiving groove or roller receiving cavity 24**, the function of which will presently be described.

Figure 9:
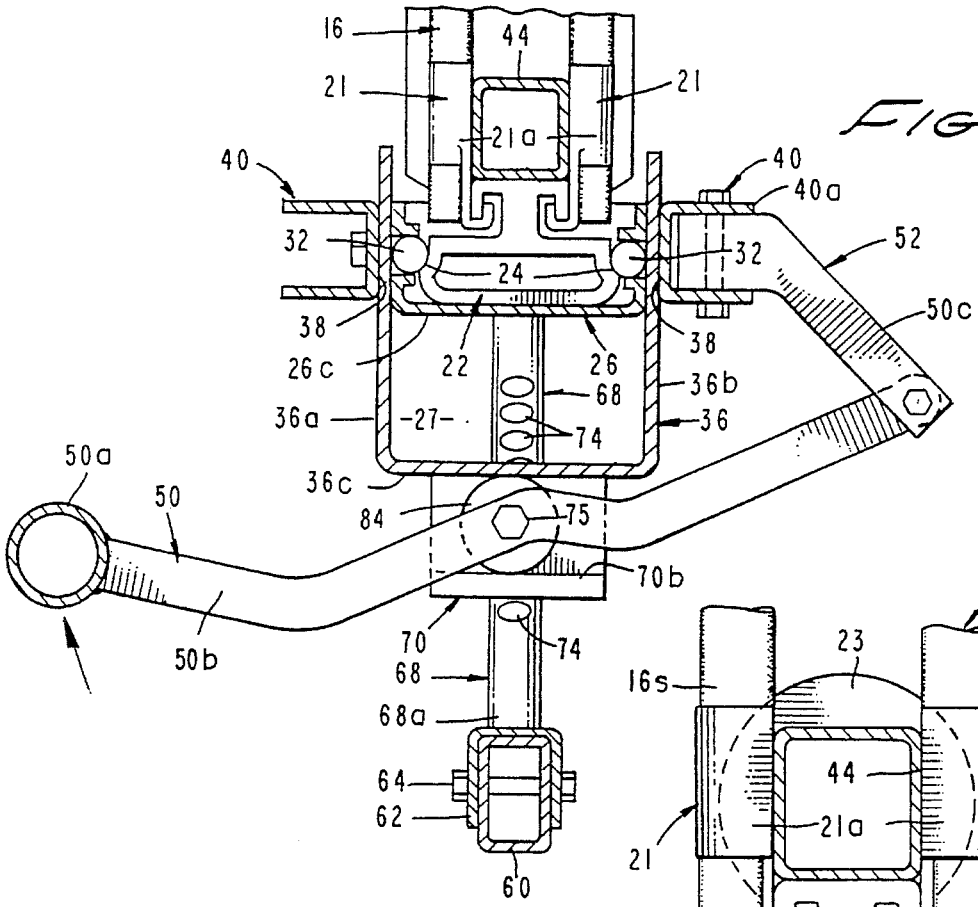
FIG. 9 is a fragmentary, cross-sectional view similar to FIG. 7 but showing the resistance selection handle in an upraised position from the position shown in FIG. 7.
Figure 11:
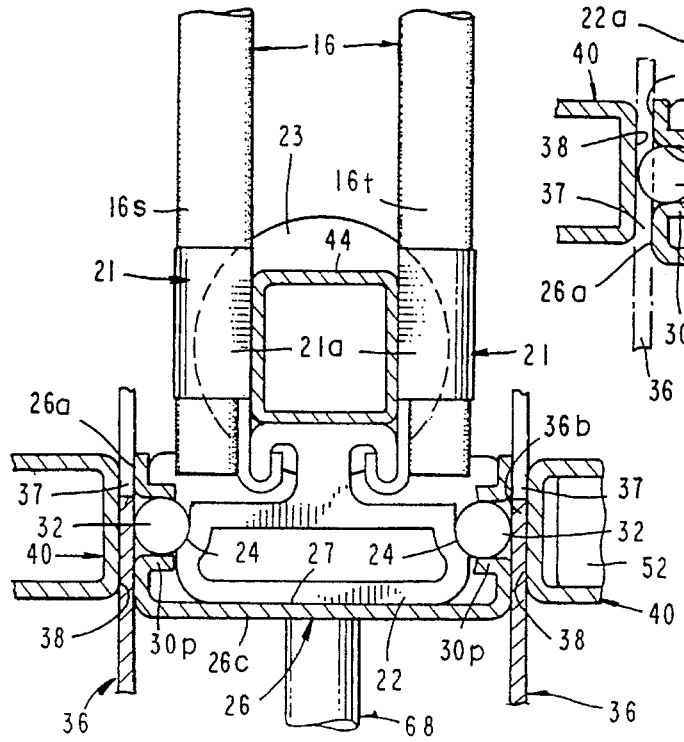
FIG. 11 is an enlarged, cross-sectional view taken along lines 11—11 of FIG. 10.
Figure 12:
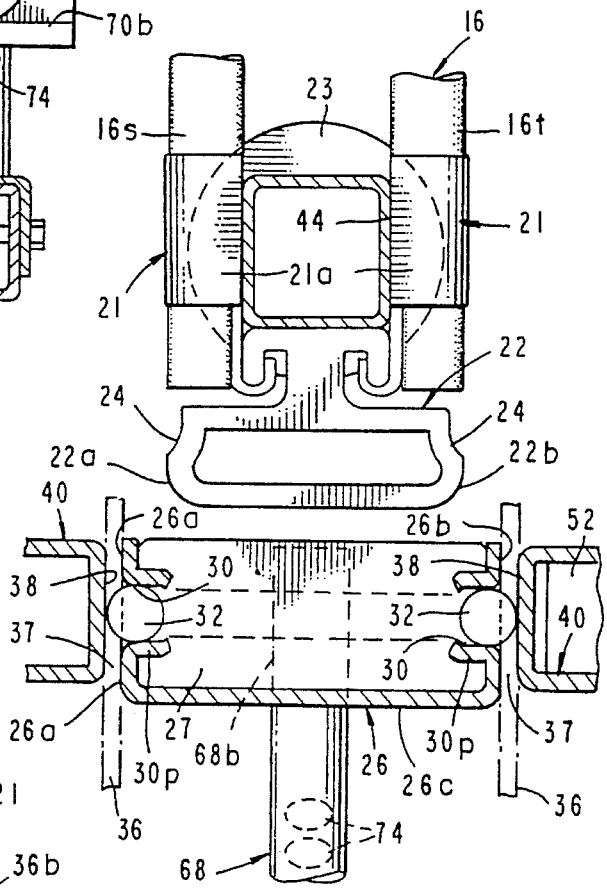
FIG. 12 is an enlarged, cross-sectional view taken along lines 12—12 of FIG. 10.
Figures 13, 14:
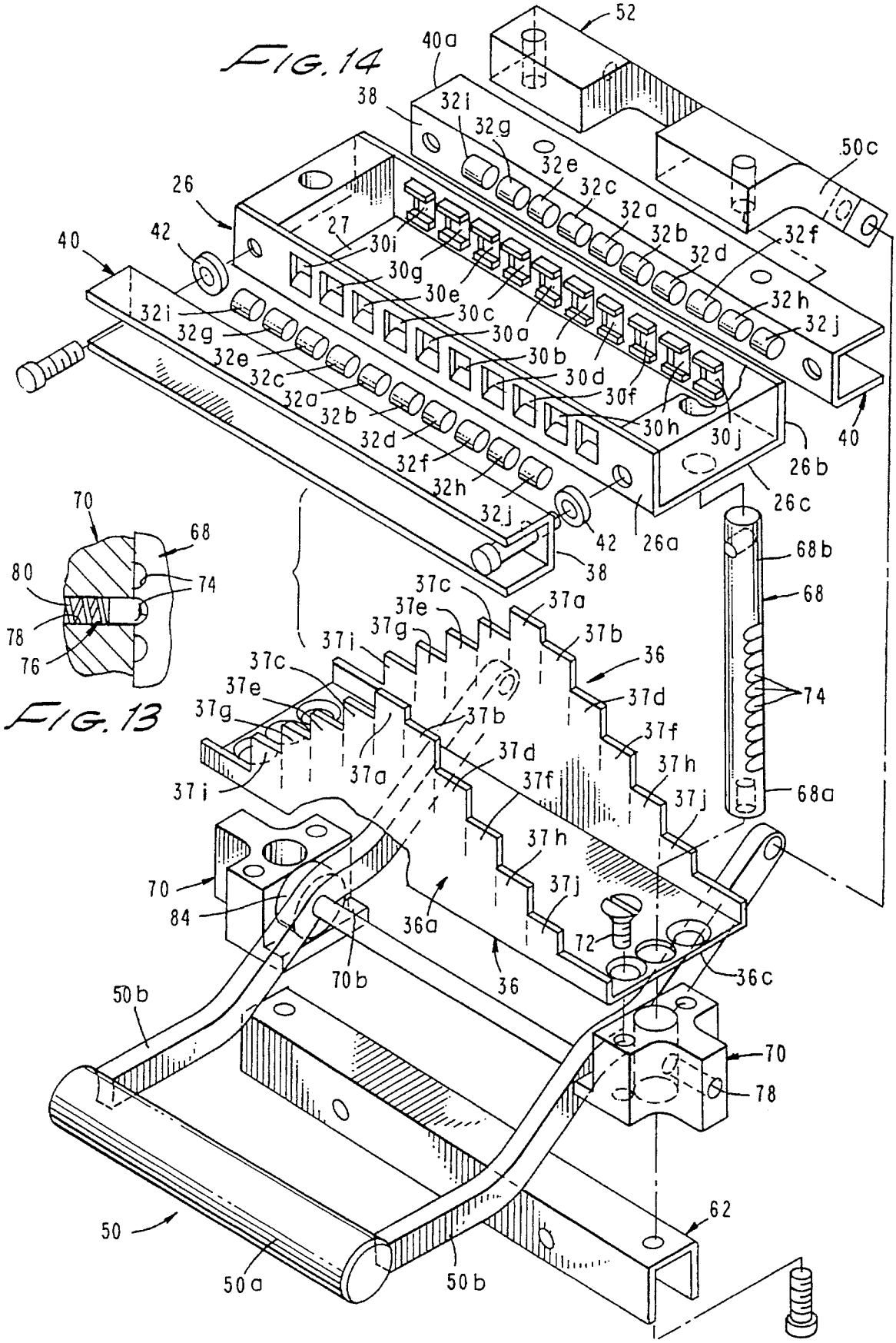
FIG. 13 is an enlarged, fragmentary view of one of the engagement pin assemblies of the apparatus of the invention.
FIG. 14 is an enlarged, generally perspective, exploded view of the base portion of the resistance means of the apparatus.

Turning to FIGS. 9, 12, and 14, the connector means of the embodiment of the invention there shown comprises receiving means for receiving connector elements 22. This receiving means here comprises a rigid plastic or metal housing 26 having first and second spaced-apart side walls **26*a* and 26*b* each of which is provided with a plurality of spaced-apart apertures 30 (FIG. 14). Each aperture 30 is specially configured to closely receive a selected one of a plurality of interengaging members or rollers 32 which are movable within the roller receiving openings or apertures 30 from the first retracted position shown in FIG. 12 to the second connector element engagement position shown in FIGS. 9 and 11. As indicated in FIG. 12, housing 26 also includes a bottom wall 26*c* which, in cooperation with side walls 26*a* and 26*b*, define a connector element receiving chamber 27. To retain the rollers within apertures 30, each of the apertures is provided with inwardly extending, lanced out portions 30*p*. Portions 30*p* function to retain rollers 32 within apertures 30 while at the same time permitting them to move inwardly of chamber 27 toward the connector element engagement position shown in FIG. 11. As indicated in FIG. 11, as rollers 32 move into the second inward position they enter the grooves 24 provided in connector elements 22 and, in this way, function to securely interlock together the connector element and housing 26** of the connector means.

Forming an important aspect of the apparatus of the present invention is the previously identified selector means which functions to move selected rollers 32 into locking engagement with selected connector elements 22. In the present embodiment of the invention, the selector means comprises a selector member 36 having spaced-apart walls 36*a* and 36*b* which are interconnected by a base 36*c*. As best seen by referring to FIG. 14, the side walls of selector member 36 are formed in a generally stair-step configuration with each wall being provided with a plurality of parallel roller engaging bands or areas which are adapted to selectively engage rollers 32 as the selector member 36 moves in a direction toward housing 26 of the connector means. More specifically, in a manner presently to be described, selector member 36 is movable between first and second positions with the side walls thereof moving into spaces 37 formed between the side walls 26*a* and 26*b* of housing 26 and the inboard walls 38 of a pair of channel-like members 40 which are disposed on either side of connector housing 26. As indicated in FIG. 14, spacers 42 are positioned between walls 26*a* and 26*b* and inboard walls 38 of members 40 to separate the walls by a distance sufficient to permit passage therebetween of walls 36*a* and 36*b* of selector member 36. As walls 36*a* and 36*b* of the selector member move into space 37, they will selectively engage rollers 32 tending to force the rollers inwardly of apertures 30 and into locking engagement with selected connector elements 22.

Turning now particularly to FIG. 14, the connector means here include a first pair of spaced-apart, generally centrally disposed rollers 32*a*, a second pair of spaced-apart rollers 32*b* disposed on one side of the first pair of rollers, and a third pair of spaced-apart rollers 32*c* disposed on the opposite side of the first pair of rollers. A fourth pair of spaced-apart rollers 32*d* is disposed proximate second pair of rollers 32*b* and a fifth pair of spaced-apart rollers 32*e* is disposed proximate third pair of rollers 32*c*. Similarly, a sixth pair of rollers 32*f* is disposed proximate rollers 32*d*, and a seventh pair of rollers 32*g* is disposed proximate rollers 32*e*. In like manner, an eighth pair of rollers 32*h* is disposed proximate rollers 32*f* and a ninth pair of rollers 32*i* is disposed proximate rollers 32*g*. Finally a tenth pair of rollers 32*j* is disposed proximate rollers 32*h*. It is to be understood that any number of rollers can be used depending upon the desired size and end use of the apparatus.

Referring also to FIG. 6, walls 36*a* and 36*b* of selector member 36 are each provided with a generally centrally disposed first roller engaging band 37*a* that is adapted to engage rollers 32*a* when selector member 36 is in its first position. As illustrated in FIG. 7, with the selector member in this first position, bands 37*a* force rollers 32*a* into locking engagement with channels 24 of the connector element 22 which is attached to the generally centrally disposed elastomeric cord 16 so that a movement of bar 18 in the direction of the arrow will cause cord 16 to stretch in a manner to yieldably resist such upward movement.

As shown best in FIG. 14, walls 36*a* and 36*b* are also provided with a second pair of spaced-apart bands 37*b* which are disposed on one side of first pair of bands 37*a*. These second bands are adapted to engage second pair of rollers 32*b* in a manner to urge the rollers inwardly of apertures 30*b*. A third pair of spaced-apart bands 37*c* are disposed on the opposite side of first pair of bands 37*a* and are adapted to engage third pair of rollers 32*c*. Similarly, a fourth pair of spaced-apart bands 37*d* are disposed proximate second pair of bands 27*b*, and are adapted to engage fourth pair of rollers 32*d*, while a fifth pair of spaced-apart bands 37*e* are disposed proximate third pair of bands 37*c*, these latter bands being adapted to engage fifth pair of rollers 32*e*. In like manner, walls 36*a* and 36*b* are provided with a sixth pair of bands 37*f* located adjacent bands 37*d*, a seventh pair of bands 37*g* located adjacent bands 37*e*, an eighth pair of bands 37*h* located adjacent bands 37*f*, a ninth pair of bands 37*i* located adjacent bands 37*g* and a tenth pair of bands 37*j* located adjacent bands 37*h*. Bands 37*f*, 37*g*, 37*h*, 37*i*, and 37*j* are adapted to engage rollers 32*f*, 32*g*, 32*g*, 32*h*, 32*i*, and 32*j* respectively as selector member 36 is moved toward connector housing 26. As these bands engage their respective rollers, the rollers will move into locking engagement with the connector elements 22 located proximate the rollers.

Figure 10:
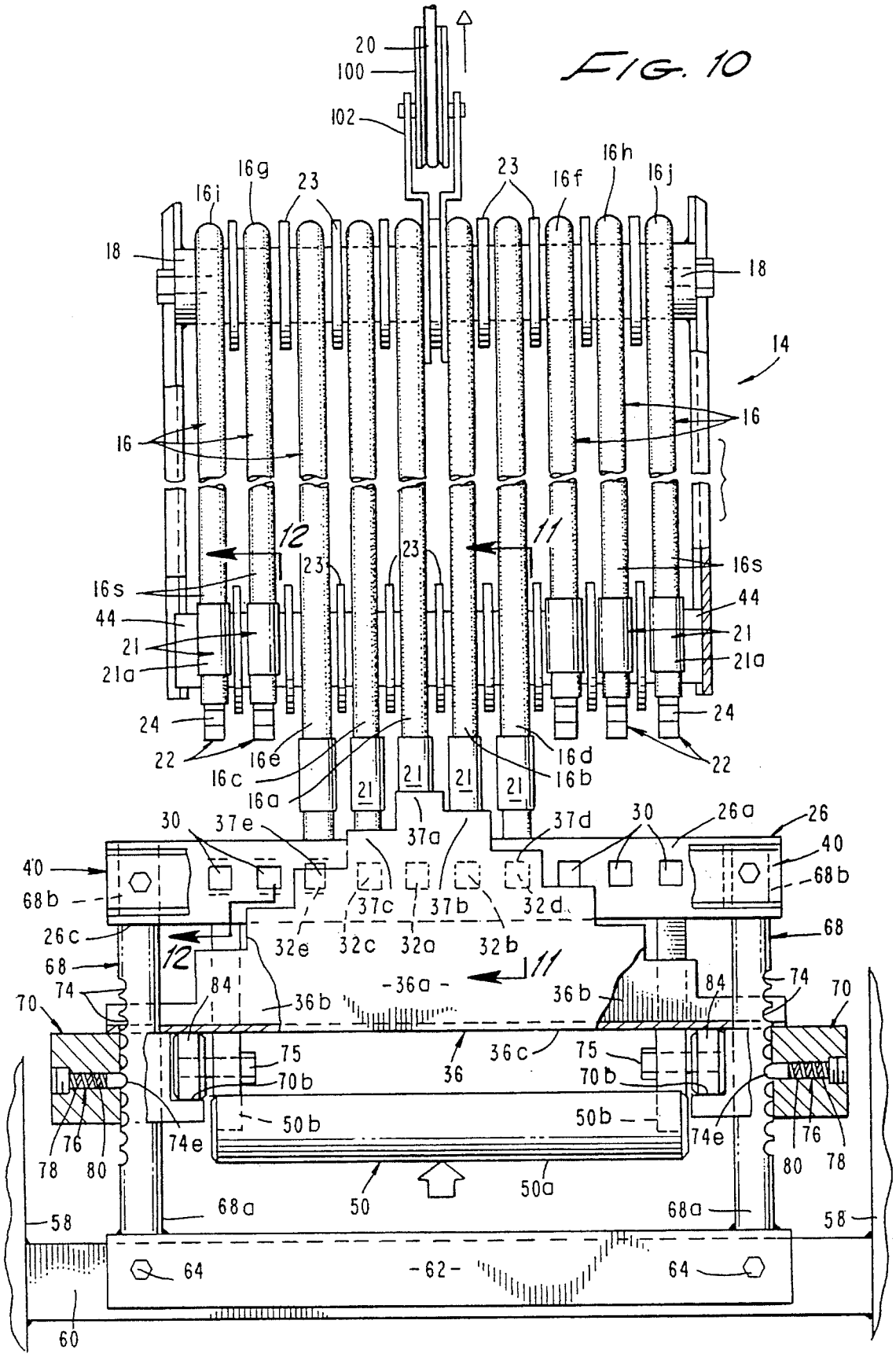
FIG. 10 is a greatly enlarged, fragmentary view of the resistance means of the apparatus similar to FIG. 6 but illustrating the manner in which additional resistance cord assemblies are interconnected with the connector housing of the connector means of the invention.

For example, as illustrated in FIG. 10, as selector member 36 is moved toward housing 26 to the intermediate position there shown, bands 37*b* and 37*c* will engage rollers 32*b* and 32*c* in a manner to move them into locking engagement with the connector elements that are connected to cords 16*b* and 16*c* respectively. This movement now couples cords 16*b* and 16*c* along with cord 16*a*, to housing 26 so that movement of bar 18 in the direction of the arrow of FIG. 6 will be resisted by the combined resistance of the three elastomeric cords.

Continued movement of selector member 36 toward housing 26 will cause bands 37*d* and 37*e* to move into engagement with rollers 32*d* and 32*e* so as to urge these rollers into locking engagement with the connector elements 22 that are connected to cords 16*d* and 16*e* and are disposed within chamber 27 proximate rollers 32*d* and 32*e*. This movement couples these cords, along with cords 16*a*, 16*b*, and 16*c* movement to housing 26 so that movement of bar 18 in the direction of the arrow will now be resisted by the combined resistance offered by the five elastomeric bands coupled to housing 26. In like manner, further movement of selector member 36 toward mating engagement with housing 26 will cause bands 37*f* and 37*g* to engage rollers 32*f* and 32*g*, thereby coupling two more cords to the housing 26. Still further movement of the selector member toward housing 26 will cause bands 37*h*, 37*i*, and 37*j* to engage rollers 32*h*, 32*i*, and 32*j* in a manner to couple the remaining elastomeric cords with housing 26. With the selector member in this final, second position, all of the cords are coupled with housing 26 thereby providing maximum resistance to the movement of bar 18 in the direction of the arrow of FIG. 6.

As previously mentioned, elastomeric cords 16 can be of the same or different elasticity so that various incremental resistance loads can be obtained as the elastomeric cords are sequentially coupled with housing 26 and with the body engaging means connected to cable 20. It is apparent that movement of selector member 36 away from housing 26 will permit sequential disconnection of the elastomeric cords from housing 26 thereby decreasing the resistance offered to movement of the body engaging means.

To ensure that the connector elements 22 are maintained in proper alignment with chamber 27 of housing 26, a second bar 44 of rectangular cross section extends across the resistance module and rests between the cord connector legs 21*a* of elements 21 in the manner shown in FIGS. 6 and 8. Additionally, upper and lower spacers 23 are provided between elements 21 and between cords 16 so as to maintain proper spacing between the elastomeric cord assemblies as connector elements 22 move into chamber 27.

In order to move the selector member between the first and second positions, a novel actuating means is provided.

In the present form of the invention, this actuating means comprises an actuating assembly made up of an actuating arm assembly 50 which is pivotally connected to an elongated member 52 (FIG. 14) which, in turn, is interconnected with the U-shaped angle member designated in FIG. 14 by the numeral 40*a*. As seen in FIGS. 7 and 14, arm assembly 50 comprises a handle 50*a*, which spans a pair of spaced apart first arm portions 50*b*, and a pair of second arm portions 50*c*, which are pivotally connected to portions 50*b*. The arm assembly can, of course, be constructed in various sizes and configurations.

Figure 4:
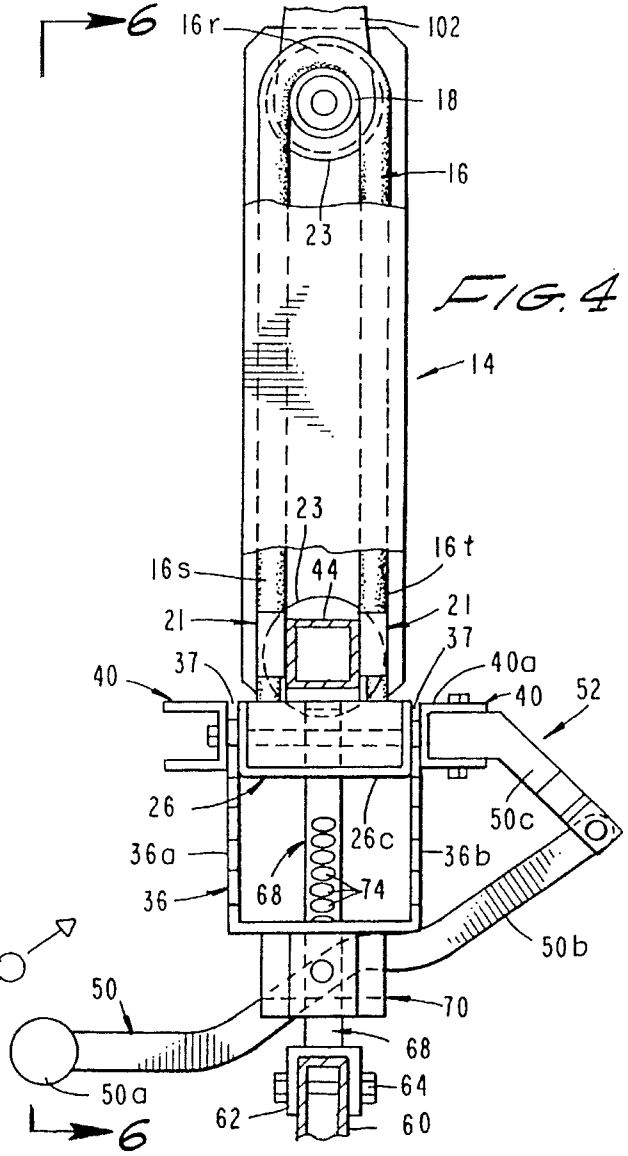
FIG. 4 is an enlarged, fragmentary view of the central portion of the apparatus wherein the resistance means is mounted.

Member 52, to which arm portions 50*b* are pivotally connected, comprises a part of the supporting frame of the apparatus, which is generally designated in FIG. 1 by the numeral 54. Supporting frame 54 includes a ground engaging base 56 to which spaced-apart side walls 58 are suitably interconnected. Extending between side walls 58 is a main support bar 60 to which a generally U-shaped channel member 62 is connected by means of bolts 64 (FIGS. 4 and 7).

Turning once again to FIGS. 6 and 14, it is to be noted that a pair of upstanding, spaced-apart guide rods 68 are connected to member 62 proximate their first or lower ends 68*a*. Guide rods 68 are also connected to housing 26 proximate their opposite, or upper ends 68*b*. Slidably receivable over guide rods 68 are supports 70 to which selector member 36 is interconnected by screws 72 in the manner illustrated in FIG. 14. With this construction, as a lifting force is applied to handle portion 50*a* of actuator arm assembly 50, supports 70 will slide along guide rods 68 and, in so doing, will move selector member 36 toward or away from the roller carrying housing 26 of the connector means. As previously mentioned, as selector member 36 moves toward housing 26 and toward the rollers 32 carried thereby, bands 37 of the selector member will sequentially engage the rollers in a manner to urge them inwardly into locking engagement with the connectors 22 that are connected to the lower ends of the various elastomeric cords 16.

To position selector member 36 at selected locations relative to connector housing 26, spring biased locking means are provided. In this regard, each of the guide rods 68 is provided with a plurality of spaced-apart pin receiving cavities 74 which are adapted to receive the inbound ends of a pair of spring-loaded locking pins 76 which form a part of the locking means of the present embodiment of the invention. Pin assemblies 76 are carried within bores 78 provided in each of the support members 70 and are biased inwardly by a spring 80 (FIGS. 6 and 14). With this construction, as supports 70 slide along guide rods 68, they will smoothly ratchet into cavities 74. Cavities 74 are spaced apart so as to correspond with the sequential engagement of bands 37 of the support member as the bands are moved into actuating engagement with the rollers 32.

The construction of the locking pin assemblies is such that, as handle 50*a* is lifted, the trainee will experience a precise, ratchet-like, tactile sensation as each level of movement of the selector member toward housing 26 is accomplished. For example, by referring to FIG. 6 it can be seen that when the pin assemblies are in engagement with the first cavities 74*a*, only band 37*a* of the selector member 36 is in engagement with roller 32*a*. However, when the lifting arm is moved to the position shown in FIG. 10 placing pin assemblies 76 in engagement with cavities 74*e*, bands 37*a*, 37*b*, 37*c*, 37*d*, and 37*e* have been moved into engagement with rollers 32*a*, 32*b*, 32*c*, 32*d*, and 32*e* respectively, thereby interconnecting elastomeric cords 16*a*, 16*b*, 16*c*, 16*d*, and 16*e* with housing 26. With the apparatus of the invention in this position, any upward movement in the direction indicated by the arrow of FIG. 10 will be resisted by the five elastomeric cords just identified. As the lifting arm assembly continues to urge selector member 36 toward connector housing 26, the locking means, or pin assemblies 76 will sequentially ratchet into engagement with the higher cavities 74 provided in the guide rods 68 so as to support the selector member in the desired position. To assist in the smooth upward movement of selector member 36, by lifting arm assembly 50, a pair of rollers 84 is disposed intermediate the bottom wall of the selector member and a shelf-like portion 70*b* of each support member 70. Rollers 84 are interconnected with arm assembly 50 by connectors 75 in the manner best seen in FIG. 7.

Turning once again to FIGS. 1, 2, and 3, a pulley arm assembly 80 is pivotally connected to the supporting frame of the apparatus at a pivot point 82. Provided at the free end of the arm assembly is a rotatable pulley 84 about which previously identified cable 20 is entrained. As indicated in FIG. 1, a body engaging means, shown here as a handle 86, is connected to a first end of cable 20. As can be seen by referring to FIGS. 1, 2, and 3, arm assembly 80 is pivotally movable from the first storage position shown in FIG. 1 to an intermediate position shown in FIG. 3 and finally to the high pulley exercise shown in FIG. 2, wherein a number of standard exercises can be performed including latissimus muscle exercises.

With the apparatus in the storage or lowered configuration shown in FIG. 1, various exercises can be performed against the resistance of the resistance means or module 14 by pulling outwardly or upwardly on handle 86. Referring also to FIG. 15, it is to be noted that a second pulley 90 is rotatably mounted on the support frame of the apparatus at a spaced-apart location from pulley 84. Similarly, a third pulley 92 is rotatably connected to base 56 of the supporting frame and a fourth pulley 94 is connected to the supporting frame at a location spaced apart from third pulley 92. A fourth pulley 96 is located in a side-by-side relationship with pulley 94 and is adapted to rotate about an axle 95 about which pulley 94 also rotates. A sixth pulley 98 is supported by base 56 for rotation about an axle 99.

With the apparatus in the lowered configuration shown in FIG. 1, cable 20 passes under pulley 84, over pulley 90, downwardly around pulley 92, and upwardly around pulley 94. The cable then passes around a pulley 100, which is interconnected with a yoke 102 which is, in turn, interconnected with bar 18 of the resistance means (FIG. 6). After cable 20 passes around pulley 100, it is entrained about pulley 96 and then extends downwardly around pulley 98.

In the simplest form of the apparatus of the invention, after cable 20 passes under pulley 98, it is connected with base 56 so that a movement of the first body engaging means or handle 86 in an outwardly direction will cause upward movement of pulley 100 against the resistance of the resistance means. In another form of the invention, which is shown in FIG. 1, cable 20 passes under a forward pulley 106 and the second end of cable 20 is connected to a second body engaging means shown here as a handle 108. In this form of the invention, a stop 110 must be provided on the cable 20 to limit rearward movement of the cable relative to pulley 106. In a similar manner, a stop 112 is provided proximate the first end of cable 20 to limit movement of the cable in a direction toward pulley 84.

In using the form of the apparatus shown in FIG. 1, either a force exerted on handle 86 in a direction away from pulley 84 or a force directed on handle 108 in a direction away from pulley 106 will cause a foreshortening of the cable in a manner to move pulley 100 in the direction of the arrow 113 of FIG. 1. Movement of pulley 100 in this direction will, of course, be resisted by one or more of the elastomeric cords 16 of the resistance means of the invention depending upon the positioning of selector member 36. It is obvious that the greater number of elastomeric cords 16 that are connected to housing 26, the greater will be the resistance against movement of the pulley 100 in the direction of arrow 113.

It is apparent that a number of different types of exercises can be performed with the apparatus in the configuration shown in FIG. 1. For example, arm and leg exercises can be performed by pulling outwardly on handle 86. Similarly, arm and leg exercises can be performed by pulling outwardly or upwardly on handle 108. To enable the efficient performance of leg exercises using the apparatus of FIG. 1, a trainee support or chair-like structure 114 is provided proximate body engaging means 108.

When it is desired to use the apparatus for the performance of overhead pulling exercises, as, for example, to exercise the latissimus muscles, arm assembly 80 is rotated from the position shown in the phantom lines in FIG. 2 to the upraised position shown in the solid lines of FIG. 2. It is to be observed that as the arm assembly moves toward the upraised position, cable 20 will entrain itself about the upper exercise pulley 116 (FIGS. 2 and 15). With the pulley arm in this position, handle 86 is elevated and can be conveniently grasped by the trainee to perform downward, pull-type exercises. Once again, as the handle 86 is moved downwardly, there will be a foreshortening of cable 20 tending to move pulley 100 in the direction of the arrow 113 in FIG. 1 against the resistance of the resistance means.

If desired, overhead exercises can also be performed by moving the apparatus into the configuration shown in FIG. 3. In this configuration, cable 20 is rearranged so as to be entrained over pulley 84 in the manner shown in FIG. 3. With the cable passing over pulley 84, a downward force exerted on the first end of the cable will cause a foreshortening of the cable and a concomitant movement of pulley 100 in the direction of the arrow.

Many other types of exercises can be performed using the basic apparatus of the invention by connecting other types of body engaging means to cable 20 with or without the addition of auxiliary pulleys. Similarly, various resistances can be obtained by tailoring the individual elastomeric cords of the resistance module to make them more or less yieldable. Finally, the support frame of the apparatus can be specifically configured to enable exercises to be performed with the exercise module in an angular or horizontal orientation with respect to the supporting surface. Additionally, any number of stations can be interconnected with the resistance module so that the apparatus can be used either as a single station device or a multistation device. In operation, the resistance cords and connector elements are self locating and automatically return to the proper place in the resistance module chamber.

As previously mentioned, the resistance module provides a full range of movement, yet it is very compact requiring only 35% of space as compared to typical prior art resistance devices. For example, using the module, the trainee can align with the high pulley station, reach across his body with his arm, and grasp the handle at the end of the cable. The trainee can then pull the handle back across his chest in a manner to fully extend the handle out and away from his torso. While these movements can be accomplished on conventional prior art weight systems, such systems require 80" to 84" guide rods for the weights to travel in order to deliver this range of motion.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercise apparatus for use by a trainee in the performance of exercises comprising:

(a) body engaging means for engagement by the trainee in the performance of exercises, said body engaging means being movable from a first to a second position;

(b) resistance means for yieldably resisting movement of said body engaging means from said first to said second position, said resistance means comprising a plurality of stretchable members, each having a connector element connected thereto;

(c) connector means for selectively interconnecting said resistance means with said body engaging means, said connector means comprising:

(i) receiving means for receiving said connector elements of said resistance means and a plurality of interengaging members movable relative to said receiving means between a first position and a second connector element engagement position, said receiving means comprising spaced apart walls for supporting said interengaging members and in which said selector means comprises a selector having spaced apart walls movable into engagement with said interengaging members to move selected ones of said interengaging members between said first and second positions;

(ii) selector means for selectively moving said interengaging members between said first and second positions.

2. An apparatus as defined in claim 1 in which each of said connector elements have end portions receivable between said walls of said receiving means, said end portions being provided with interengagement member receiving openings for receiving said interengagement members when said members are in said second connector engagement position.

3. An apparatus as defined in claim 2 in which said interengagement members comprise rollers movable relative to said walls of said receiving means.

4. An apparatus as defined in claim 3 in which said rollers include a first pair of spaced-apart, generally centrally disposed rollers; a second pair of spaced-apart rollers disposed on one side of said first pair of rollers; a third pair of spaced-apart rollers disposed on the opposite side of said first pair of rollers.

5. An exercise apparatus for use by a trainee in the performance of exercises comprising:

(a) body engaging means for engagement by the trainee in the performance of exercises, said body engaging means being movable from a first to a second position;

(b) resistance means for yieldably resisting movement of said body engaging means from said first to said second position, said resistance means comprising a plurality of elongated elastomeric members each having a connector element connected thereto;

(c) connector means for selectively interconnecting said resistance means with said body engaging means, said connector means comprising:

(i) a housing having spaced-apart walls defining a chamber for receiving said connector elements, said walls having spaced-apart apertures for receiving a plurality of interengaging members movable relative to said chamber between a first, retracted position and a second connector element engagement position;

(ii) selector means movable relative to said housing for selectively moving said interengaging members between said first and second positions, said selector means comprising a selector member having spaced-apart walls provided with a plurality of member engaging areas movable into engagement with said members to move said members between said first and second positions; and (iii) actuating means for moving said selector member toward said housing of said connector means.

6. An apparatus as defined in claim 5 in which said exercise apparatus comprises a supporting frame and in which said actuating means comprises a selector arm pivotally connected to said frame and engagable with said selector member for moving said selector member toward said housing of said connector means.

7. An apparatus as defined in claim 5 in which said plurality of members comprise a plurality of rollers.

8. An apparatus as defined in claim 7 in which said plurality of spaced-apart member engaging areas include a first pair of spaced-apart, generally centrally disposed areas; a second pair of spaced-apart areas disposed on one side of said first pair of areas; and a third pair of spaced-apart areas disposed on the opposite side of said first pair of areas.

9. An exercise apparatus for use by a trainee in the performance of exercises comprising:

(a) a supporting frame;

(b) an arm assembly pivotally connected to said supporting frame for movement between a lowered position and an upraised position, said arm assembly including a first pulley;

(c) a cable entrained around said first pulley, said cable having first and second ends;

(d) first body engaging means connected to said first end of said cable for movement between a first and second position;

(e) resistance means for yieldably resisting movement of said first end of said cable between said first and second positions, said resistance means comprising:

(i) a first support interconnected with said cable;

(ii) a plurality of elongated elastomeric members entrained around said support, each said elongated elastomeric member having first and second ends;

(iii) a plurality of connector elements, each said connector element being connected to said first and second ends of one of said elongated elastomeric member and each said connector element having spaced apart roller receiving cavities; and (f) connector means for selectively connecting said connector elements to said frame, said connector means comprising:

(i) a housing having spaced apart walls provided with a plurality of spaced apart roller receiving openings and a plurality of rollers carried within said roller receiving openings and movable between a first retracted position and a second engagement position; and (ii) selector means movable relative to said housing for selectively moving said rollers from said retracted position into said engagement position, said selector means comprising a selector member connected to said frame and movable relative to said housing between first and second positions to move selected rollers of said housing into said engagement position.

* * * * *